US007210872B2

(12) United States Patent
Brennfleck

(10) Patent No.: US 7,210,872 B2
(45) Date of Patent: May 1, 2007

(54) CONNECTION ELEMENT

(75) Inventor: Matthias Michael Brennfleck, Pfarrstrasse 28, 76189 Karlsruhe (DE)

(73) Assignees: Matthias Michael Brennfleck, Karlsruhe (DE); Martin Andreas Brennfleck, Karlsruhe (DE); Dieter Alois Brennfleck, Karlsruhe (DE)

( * ) Notice: Subject to any disclaimer, the term of this patent is extended or adjusted under 35 U.S.C. 154(b) by 0 days.

(21) Appl. No.: 10/780,283

(22) Filed: Feb. 17, 2004

(65) Prior Publication Data

US 2004/0184870 A1 Sep. 23, 2004

(30) Foreign Application Priority Data

Feb. 20, 2003 (DE) ..... 203 02 832 U

(51) Int. Cl.
*F16B 2/18* (2006.01)

(52) U.S. Cl. ..... 403/217

(58) Field of Classification Search ..... 403/169, 403/19, 20, 321, 322.1, 323, 348, 350; 16/230, 16/231, 247, 261, 303, 383; 52/656.9, 657; 312/107.5, 111, 140, 215, 183
See application file for complete search history.

(56) References Cited

U.S. PATENT DOCUMENTS 4,131,376 A * 12/1978 Busse ..... 403/12
4,185,410 A * 1/1980 Kristiansen ..... 446/104
4,288,892 A * 9/1981 Mardirossian ..... 24/307
4,301,636 A * 11/1981 Luria ..... 312/111
5,083,512 A * 1/1992 Newhouse et al. ..... 108/50.02
5,833,417 A * 11/1998 Sargent et al. ..... 411/85
6,503,655 B1 * 1/2003 Petricevic et al. ..... 429/42

FOREIGN PATENT DOCUMENTS

GB 1359480 A * 7/1974

* cited by examiner

*Primary Examiner*—Daniel P. Stodola
*Assistant Examiner*—Joshua T. Kennedy
(74) *Attorney, Agent, or Firm*—Egbert Law Offices

(57) ABSTRACT

A connection element of the present invention has several jaw sidewalls that are oriented in different directions, whereby two jaw sidewalls at a time can be braced against each other to receive a component part. At least one jaw sidewall can be set so that it is adjustable on the connection element and this jaw sidewall projects by a lateral leg into the inside of the connection element. There is in active connection with an adjustment element that is to be activated from the outside in a direction to brace or detach the jaw sidewall. With the connection element according to the invention, it is possible to connect the plates of a shelf construction system together without nails, screws and the like.

15 Claims, 9 Drawing Sheets

CONNECTION ELEMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention involves a connection element for detachable connection of adjacent component parts, especially for shelving-type systems.

BACKGROUND OF THE INVENTION

Connection elements of this type are used especially for the connection of furniture parts such as wall plates and floor plates, for example, in shelving construction or fair (tradeshow) exhibit construction. Customary connection elements are angles, for example, which are affixed with screws or nails to the parts to be connected. This is time-consuming; and moreover, the component parts are irreversibly damaged in these customary connection systems by the screwing-in of the screws or the driving in of the nails. Also, the detachment of component parts once they are connected is problematic. In particular, in a frequent assembly and disassembly of building systems, for example, in fair or tradeshow exhibit construction, customary connection elements cause considerable disadvantages.

BRIEF SUMMARY OF THE INVENTION

The purpose of the present invention is to provide a connection element, for the connection of adjacent component parts, in which the individual component parts can be connected and detached quickly and reliably to and from each other, without the component parts becoming damaged in the process. The connection element according to the invention should be distinguished by a cost-effective manufacturing and a simple operational method.

This purpose is achieved according to the invention in that the connection element has several jaw sidewalls that are oriented in different directions, whereby 2 jaw sidewalls at a time can be braced against each other to receive a component part, in that at least one jaw sidewall can be set so that it is adjustable on the connection element and this jaw sidewall projects by a lateral leg into the inside of the connection element and there is in active connection with an adjustment element that is to be activated from the outside in a direction to brace or detach the jaw sidewall.

With the connection element according to the invention, it is possible to connect the plates of a shelf construction system together without nails, screws and the like. Each structural component is plugged in between two opposing jaw sidewalls of the connection element, whereby the distance of the jaw sidewalls is selected so that the component parts fit between the jaw sidewalls with sufficient play. Then, the jaw sidewalls are braced against each other. To do this, the position of at least one jaw sidewall is varied on the connection element. This jaw sidewall can be set so that it can pivot around a rotational axis, whereby this can also involve a fictitious rotational axis that is essentially formed by supports on adjacent parts. The adjustment of the jaw sidewall is done using an adjustment element which is located inside the connection element. In the process, the adjustment element acts on a lateral leg which is added to the jaw sidewall and which projects inside the connection element. The lateral leg is pivoted in the process around the rotational axis, and the respective component part is braced or detached between the corresponding jaw sidewalls.

In principal, it is conceivable that both corresponding jaw sidewalls can be adjusted. In an especially advantageous embodiment of the invention, however, the adjustable jaw sidewall lies opposite a rigid jaw sidewall. When the adjustment element is activated, the adjustable jaw sidewall then presses the structural component against the rigid jaw sidewall and/or releases it again for detachment.

It is especially favorable to use, as an adjustment element, an eccentric that is set in bearings so that it can rotate and that can by rotation enter into a self-locking brace with the lateral leg. By the pressure of the eccentric on the lateral leg, the jaw sidewall is rotated in the direction to the component part. If the eccentric is turned in the opposite direction, then the bracing becomes detached and the jaw sidewall is again given more play.

In an advantageous embodiment of the invention, the eccentric is in an active connection with the 2 lateral legs, which are allocated to the different jaw sidewalls. Thus, by turning one eccentric, two jaw sidewalls can be activated simultaneously. In this way, it is possible in one step to brace two component parts between two jaw sidewall pairs. The eccentric presses on the lateral leg of the adjustable jaw sidewall of the respective jaw sidewall pair and pivots the lateral leg around its rotational axis, so that two component parts are affixed at the same time. In the process, it is recommended to set the adjustment element in bearings so that it can rotate via circular cylinder surfaces in the connection element, and to dimension this bearing with a radial bearing play of approx. 0.4 millimeters to approx. 1 millimeter. This has the advantage that, for two component parts with possible different thickness lying opposite each other, an equalization takes place automatically because the adjustment element can give way somewhat to the side. As a result, plates of different thicknesses are thus also held between the jaw sidewalls of one and the same adjustment element with a clamping force of approximately the same strength.

Of course, the adjustment element can also act on more than two jaw sidewalls.

It has proven to be especially favorable if the lateral legs grasp on sides of the eccentric that lie opposite each other diagonally. By turning the eccentric, jaw sidewalls arranged diagonally to each other are then activated simultaneously, which presses the component parts against the associated fixed jaw sidewalls. In this way, component parts following one another in a row can be connected.

With the connection element according to the invention, it is also possible to connect two component parts that are oriented perpendicularly to each other. Furthermore, four component parts running towards each other in a cross-shape can also be connected with the device. In this case, the connection element has two eccentrics arranged approximately coaxially over each other. By activation of the first eccentric, the component parts running toward each other from left and right are braced between the respective jaw sidewall pairs; by activation of the second eccentric, the component parts running towards each other from front to back or from top to bottom are braced.

So that the eccentrics act only on the lateral leg allocated to them, the lateral legs have, opposite the eccentric not allocated to them, an offset so that the eccentric can not come into contact there when it is turning. The offset extends as a rule over an area which corresponds to the thickness of the eccentric that is not allocated.

The activation of the eccentric is done preferably with the Allen-type wrench, in particular, the hexagonal Allen-type wrench. In case of two eccentrics arranged one above the other, the one eccentric can be activated through an opening of the other eccentric. The eccentrics arranged one above the other are activated by variably sized hexagonal Allen wrenches. The wrench opening of the upper eccentric is larger than the wrench opening of the lower eccentric, so that the smaller Allen-type wrench can be used to grasp through the opening of the upper eccentric in order to activate the lower eccentric. When turning the lower eccentric, the wrench moves with sufficient play within the opening of the upper eccentric so that the upper eccentric is not turned. In order to turn the upper eccentric, the larger wrench is used, which is introduced into the large opening of the upper eccentric until reaching the stopper on the lower eccentric. The guidance of the wrench can in the process be supported through a cover with a suitable opening.

So that the connection element can also be used for component parts with large wall thickness differences, it is recommended that on the jaw sidewalls, spacers can be clamped or made to catch. These spacers can, for example, surround the jaw sidewalls laterally or be held in recesses of the jaw sidewall.

Furthermore, it is recommended that these spacers have a bent extension on part of their edge. This extension functions for the rear wall mounting and provides a savings of separate angle pieces.

Instead of this, the spacers can also have on their edge a hinge with a rotating bracket, whereby this bracket functions for the attachment of door elements.

BRIEF DESCRIPTION OF THE SEVERAL VIEWS OF THE DRAWINGS

Additional characteristics of the invention result from the description of embodiment examples using the drawings and from the drawings themselves.

DETAILED DESCRIPTION OF THE INVENTION

Figure 1:
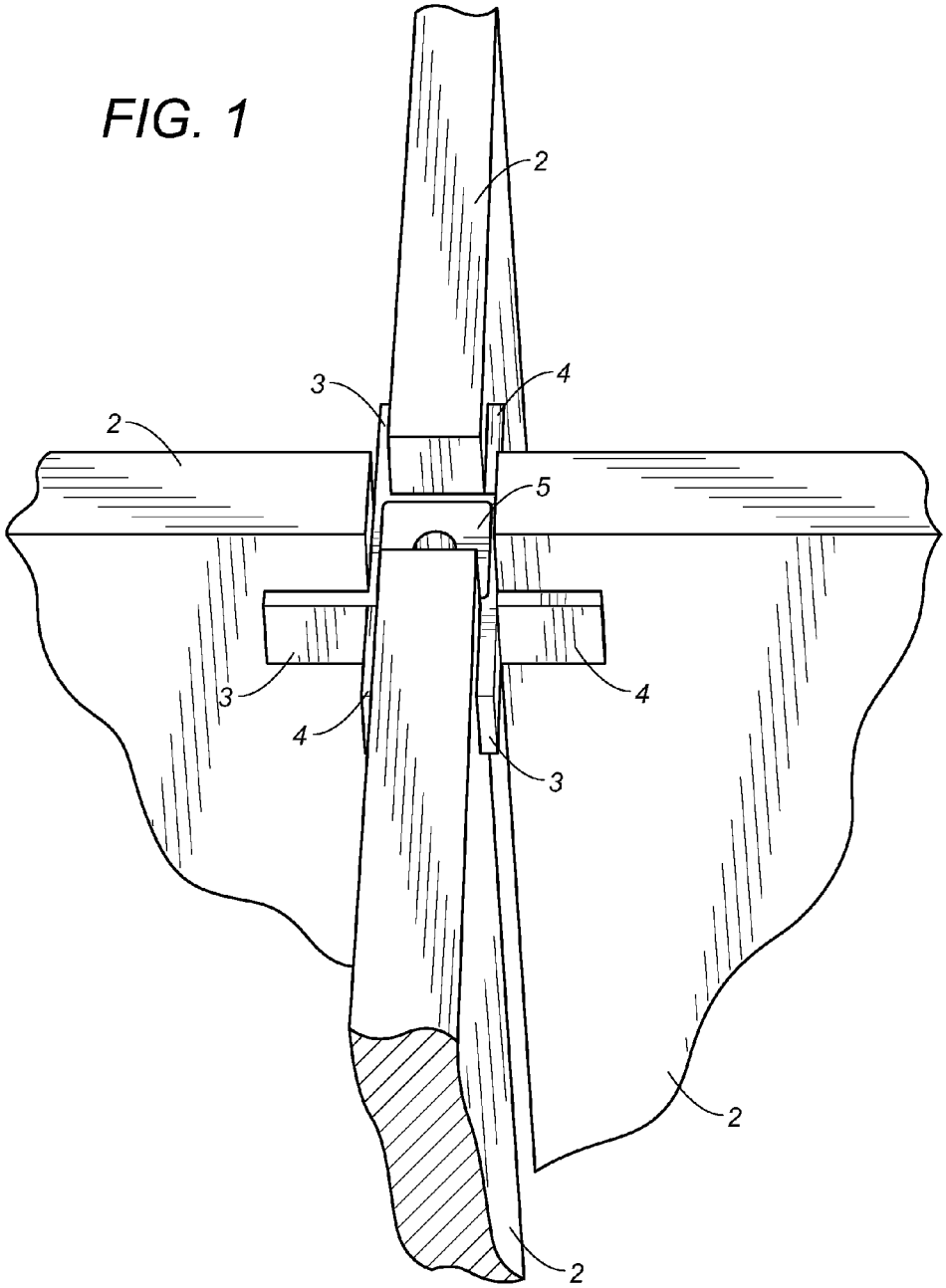
FIG. 1 is a perspective view of the elements according to the invention for the connection of plates running towards each other in a cross-shape.

In FIG. 1, it can be recognized that with the connection element 1 according to the invention, four component parts running towards each other in a cross-shape are connected in the form of plates 2. The plates 2 are clamped between rigid jaw sidewalls 3 and movable jaw sidewalls 4. The rigid jaw sidewalls 3 are part of the housing 5 of the connection element 1.

The entire connection element can be manufactured out of metal; in the process, it is recommended to coat the jaw sidewalls on their sides that face the plates 2 with flexible plastic or to mount detachable plastic plates there in order to protect the component parts to be braced. Of course, the jaw sidewalls as well as the remaining parts of the connection element can also consist directly of plastic.

Figure 2:
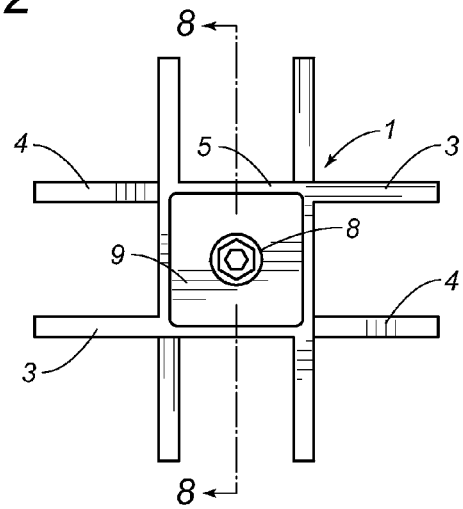
FIG. 2 is a top plan view of a cross-shaped connection element without plates.

In FIG. 2, the connection element 1 is shown in a top view. The housing 5 can be recognized, on which four rigid jaw sidewalls project out. Opposite the rigid jaw sidewalls 3, the four movable jaw sidewalls 4 are set in bearings on the housing 5 so that they can rotate. Between the respective jaw sidewall pairs, the plates 2 to be connected are braced. In the process, the plates 2 are right next to housing 5 of the connection element 1 and fill the intermediate space between the jaw sidewalls 3, 4. In the housing 5, two eccentrics 6, 7 that are set in bearings so that they can rotate are arranged coaxially one above the other and with them, the movable jaw sidewalls 4 can be adjusted. The eccentrics 6, 7 have in the center in their rotational axis an opening 8, into which a hexagonal Allen-type wrench can be inserted, in order to turn the eccentrics 6, 7 in this way. The opening 8 of the lower eccentric 6 is smaller than the opening 8 of the upper eccentric 7. The housing 5 is closed with a cover 9, so that the eccentrics 6, 7 can not fall out. The cover 9 can be pressed into the housing 5 by press-fit. Instead or in addition, it can be adhered or welded (fused) to the housing 5.

Figure 3:
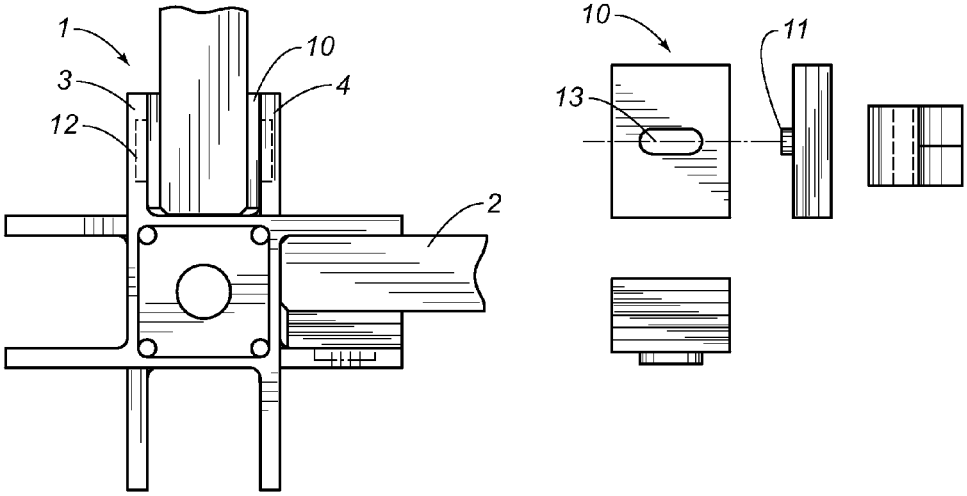
FIG. 3 is a top plan view of a cross-shaped connection element with two plates and next to it, the corresponding spacers.

In FIG. 3, the connection element 1 with plates 2 is shown as a top view. The jaw sidewalls 3, 4 are provided with spacers 10. The spacers 10 have a nose 1 1, which can be pressed into a recess 12 of the jaw sidewalls 3, 4, so that a mounting and an exact positioning of the spacer 10 is ensured on the jaw sidewalls 3, 4. It is thus also possible to combine several spacers 10 with each other. To do this, they are provided on their rear side with a recess 13, in which the nose 11 of another spacer 10 fits. In this way, in the combination of several spacers 10, a fixing of one below the other is ensured. By the use of spacers 10, it is possible to brace plates of different thicknesses into the connection element 1, whereby the possibly remaining room between the respective plate 2 and the jaw sidewalls 3, 4 is filled with spacers 10.

Figure 4:
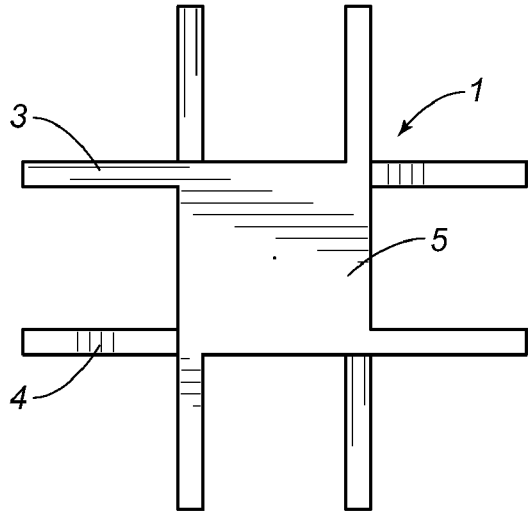
FIG. 4 is a bottom view from below onto a cross-shaped connection element.

In FIG. 4, the connection element 1 is shown from below. It can be recognized that the housing 5 is closed firmly on its underside.

Figure 5:
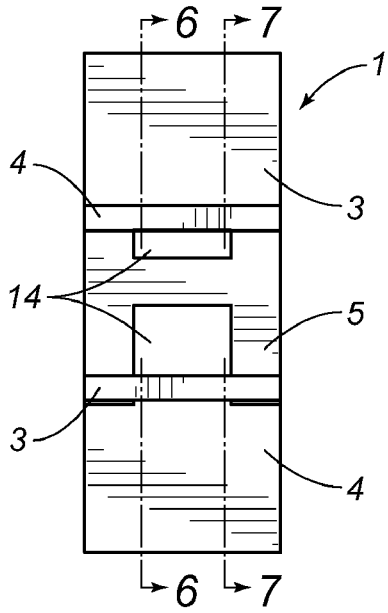
FIG. 5 is a side elevation view of a cross-shaped connection element.

FIG. 5 shows a side view of the connection element 1. The lateral leg 14 of the movable jaw sidewalls 4, which are set in bearings so that they can pivot on the housing 5 of the connection element 1, can be recognized. The lateral legs 14 are thickened opposite the movable jaw sidewalls 4 and do not extend over the entire width of the jaw sidewalls 4 but only in the middle area.

Figure 6:
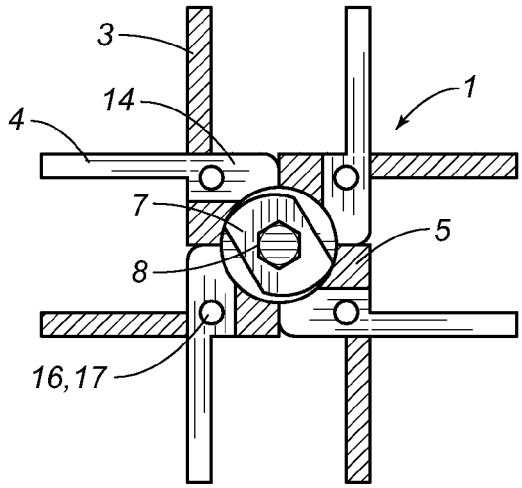
FIG. 6 is a horizontal sectional view through the connection element along the B—B axis from FIG. 5.

In FIG. 6, a section along the B—B line from FIG. 5 is shown. The upper eccentric 7, which is set in the connection element 1 so that it can rotate, can be recognized. The eccentric 7 has in its center a hexagonal opening 8, into which an Allen-type wrench can be inserted and in this way, the eccentric 7 can be turned. The lateral leg 14 of the movable jaw sidewalls 4 are integrated into recesses 15 of the housing 5. On their rotational axis, the lateral legs 14 are provided with a drill hole 16, through which a pin 17 is guided. The pin 17 extends on its upper and lower end into drill holes 18 on the housing 5. The movable jaw sidewalls 4 are thus set in bearings so that they can rotate around the pin 17 on the housing 5. The eccentric 7 can act simultaneously on the diagonally opposing right and left lateral legs 14. When turning the eccentric 7 in the clockwise direction, the left and right movable jaw sidewalls 4 are pivoted in the direction to the opposing rigid jaw sidewall 3. This results in a self-locking brace between the eccentric 7 and the lateral leg 14. By turning the eccentric 7 opposite the clockwise direction, the clamping is undone again, so that the movable jaw sidewall 4 can be opened again.

Figure 7:
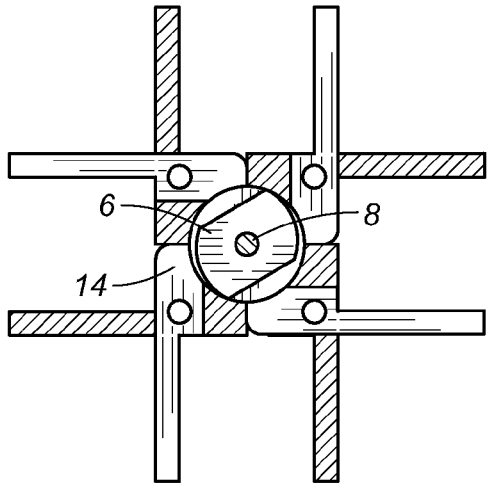
FIG. 7 is a horizontal sectional view through the connection element along the C—C axis from FIG. 5.

In FIG. 7, a section along the line C—C from FIG. 5 is shown. The lower eccentric 6 can be seen, which is in active connection with the front and the rear diagonally opposing lateral legs 14. The opening 8 of the lower eccentric 6 is smaller than the opening 8 of the upper eccentric 7. The Allen-type wrench for operation of the lower eccentric 6 can be guided through the opening 8 of the upper eccentric 7. Conversely, the lower eccentric 6 functions as a stopper for the wrench for operation of the lower eccentric 7.

Figure 8:
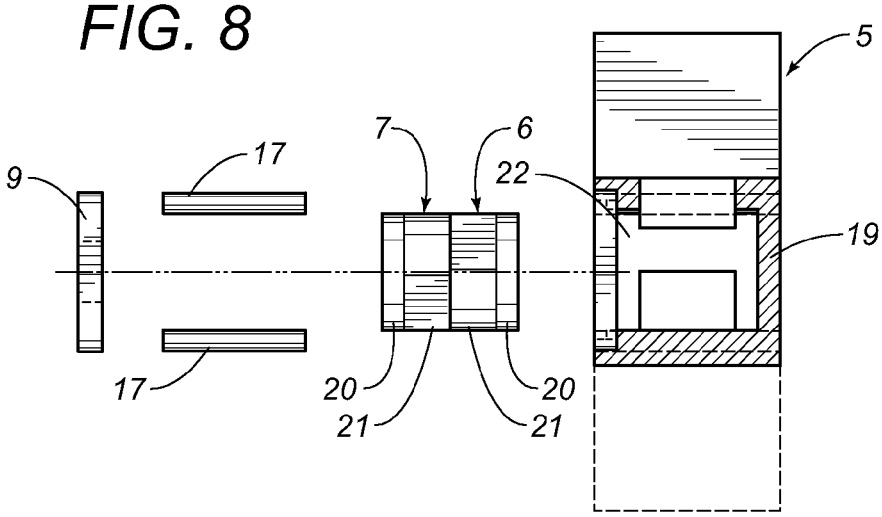
FIG. 8 is a vertical sectional view through the connection element along the A—A axis from FIG. 2.

FIG. 8 shows a section through the housing 5 along the line A—A from FIG. 2 in an exploded view. The eccentrics 6, 7 are inserted into the housing 5 and abut against the floor 19 of the housing 5. The eccentrics 6, 7 become subdivided into a circular conductor section 20 and an angular section 21. The circular conductor sections 20 are somewhat smaller in their diameter than the cylindrical inner space 22 of the housing 5. In this way, the eccentrics 6, 7 can rotate in the housing 5 and are simultaneously guided in it. The eccentrics rest with their circular conductor section 20 on the floor 19 and the cover 9 and adjoin each other with their end faces of their active section 21. In addition, in FIG. 8, the pins 17 for mounting the movable jaw sidewalls 4 can be seen on the housing 5.

Figure 9:
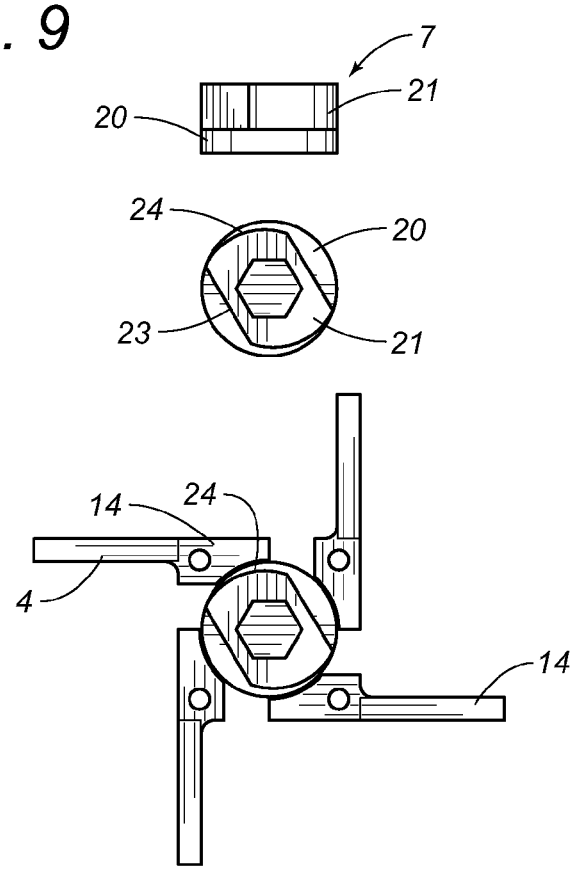
FIG. 9*a*: A side view of the eccentric.
FIG. 9*b*: A top view of the eccentric.
FIG. 9*c*: A diagram of the eccentric and lateral legs in active connection.

In FIGS. 9*a*–9*c*, the upper eccentric 7 is shown in a side view, top view and in active connection with the movable jaw sidewalls 4. The circular conductor section 20 and the angular section 21 of the eccentric can be seen. The active connection 21 has two flattened sides 23 and two eccentrically rounded off sides 24. The diameter of the eccentrically rounded off sides 24 decreases continuously in the clockwise direction starting with the diameter of the circular conductor section 20. The rounded off sides 24 face towards the left and the right lateral legs 14. When the eccentric 7 turns, there is no interaction with these lateral legs 14, while the front and rear lateral legs remain unaffected because they are in active connection to the other eccentric 6.

Figure 10:
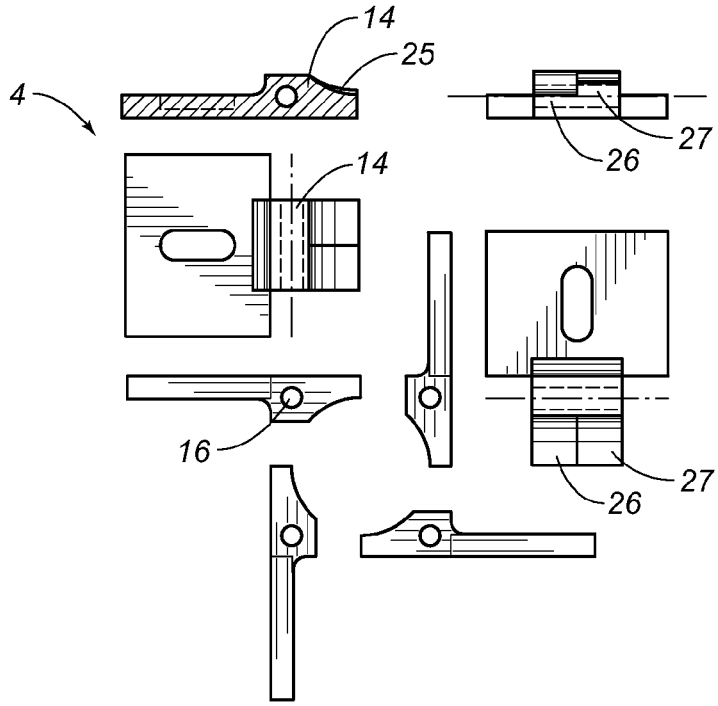
FIG. 10 shows an exploded perspective view and sectional view of the lateral leg.

FIG. 10 shows the movable jaw sidewalls 4 with their lateral legs 14 from several perspectives. The lateral legs 14 are thickened in comparison with the movable jaw sidewalls 4. The lateral leg 14 has the largest thickness on its transition to the movable jaw sidewall 4. The thickness at first stays constant in the longitudinal direction of the lateral leg 14 and then it decreases in a flattening curve. The flattened part 25 of the lateral leg 14 becomes subdivided along its width into two areas 26, 27, whereby the area 26 becomes more flattened and thus is thinner than the area 27. In the lateral leg 14 shown in FIG. 10, the area 27 is in an active connection with the upper eccentric 7. Area 26 adjoins the lower eccentric 6. Because of the offset of area 26 as opposed to area 27, however, an interaction with the non-allocated, lower eccentric 6 is prevented. In FIG. 10, the drill holes 16 are also shown, via which the lateral legs 14 can be affixed to the housing 5 using pins 17.

Figure 11:
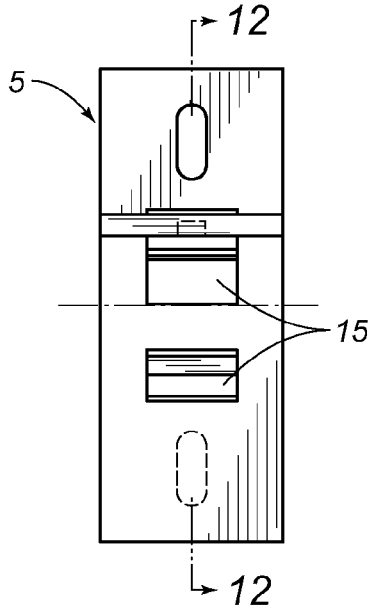
FIG. 11 is a side elevation view of the housing of the connection element.

In FIG. 11, a side view of the empty housing 5 is shown. The recesses 15 on the housing 5 function for the profile of the lateral legs 14.

Figure 12:
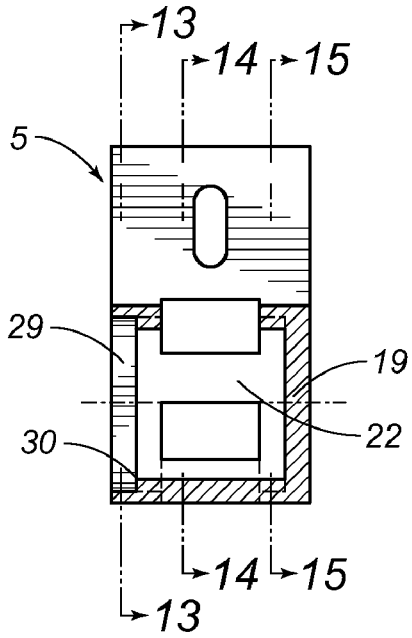
FIG. 12 is a sectional view through the housing along the D—D axis from FIG. 11.

FIG. 12 shows a section through the housing 5 along the D—D axis from FIG. 11. In the inner space 22 of the housing 5, the two eccentrics 6, 7 are introduced, so that the lower eccentric 6 rests on the floor 19 of the housing 5. The housing 5 can be closed with a cover 9, which is inserted into the area 29 of the housing 5 and abuts against the inner walls 30 of the housing.

Figure 13:
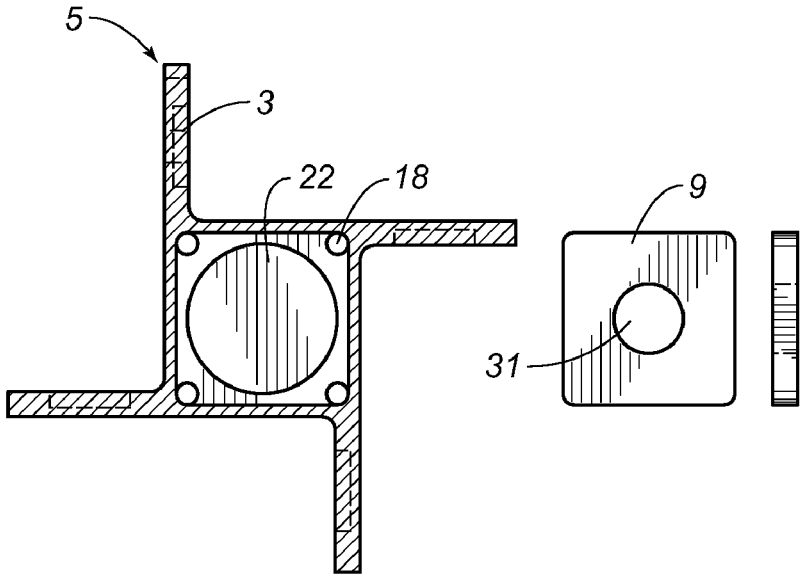
FIG. 13 is a sectional view through the housing along the A—A axis from FIG. 12.

In FIG. 13, a section through the housing 5 along the A—A axis from FIG. 12 and the cover 9 to close the housing 5 is shown. The rigid jaw sidewalls 3 are molded as a single piece onto the housing 5. The diameter of the cylinder-shaped inner space 22 is somewhat larger than the diameter of the eccentrics 6, 7, so that they fit into the inner space 22 and simultaneously are conducted by the inner walls of the housing. The drill holes 18 function to receive the pins 17 with which the lateral legs 14 are attached on the housing 5. The cover 9 has in its center a drill hole 31, so that the eccentrics 6, 7 can also be operated with the Allen-type wrench when the cover is closed.

Figure 14:
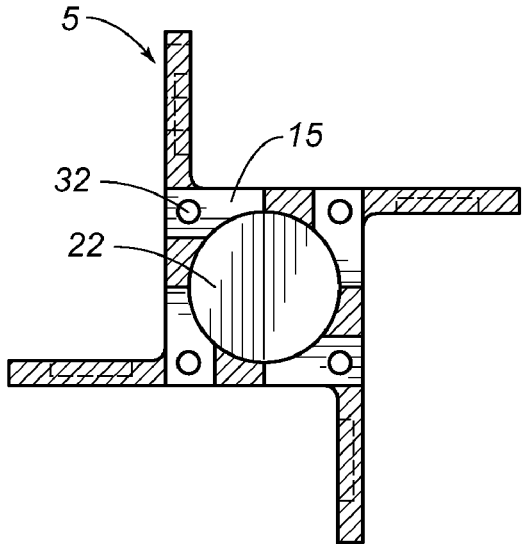
FIG. 14 is another sectional view through the housing along the B—B axis from FIG. 12.

FIG. 14 shows a section through the housing 5 along the B—B axis drawn in FIG. 12. The recesses 15 function again to receive the lateral legs 14 which are set in bearings so that they can rotate around the axis 32.

Figure 15:
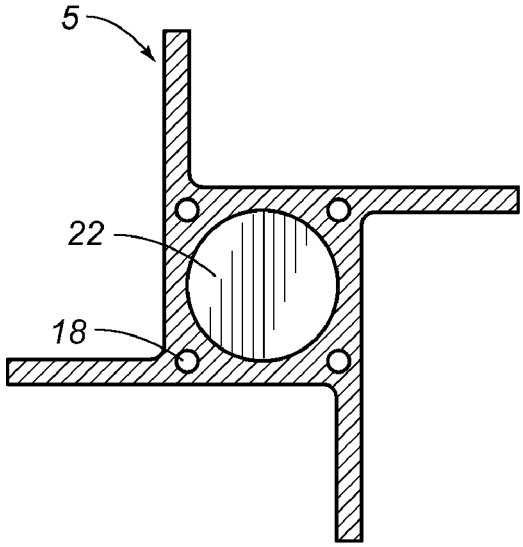
FIG. 15 is another sectional view through the housing along the C—C axis from FIG. 12.

In FIG. 15, a section through the housing 5 is shown along the C—C axis drawn in FIG. 12. The cylindrical inner space 22 of the housing 5 is shown, in which the lower eccentric 6 rests on the floor 19 of the housing 5 so that it can be rotated. In addition, the drill holes 18 for receiving the pins 17 are shown. The pins are used to affix the lateral legs to the housing 5.

Figure 16:
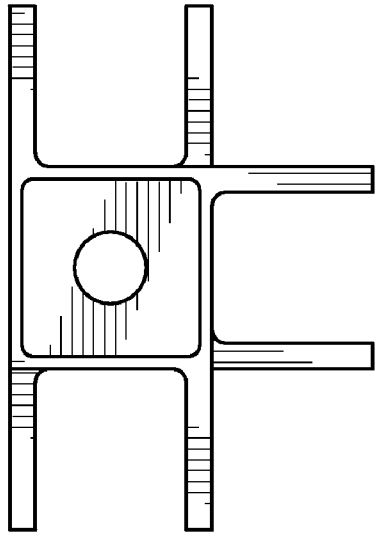
FIG. 16 is a top plan view of a T-shaped connection element.
Figure 17:
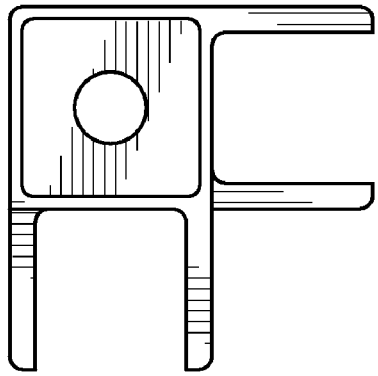
FIG. 17 is a top plan view of an L-shaped connection element.

FIGS. 16 and 17 show two alternative embodiment forms of the connection elements according to the invention. In FIG. 16, a T-shaped connection element is shown, which can be used for the connection of three plates, for example, as a border profile of a furniture construction system. FIG. 17 shows an L-shaped connection element for the connection of two plates as a corner profile.

I claim:

1. A connection device for detachably connecting component parts comprising:

a connection element;

a first jaw sidewall extending from said connection element;

a second jaw sidewall extending from said connection element and arranged with respect to said first jaw sidewall so as to hold one of the component parts, said first and second jaw sidewalls being oriented in a first orientation with respect to said connection element;

a third jaw sidewall extending from said connection element;

a fourth jaw sidewall extending from said connection element and arranged with respect to said third jaw sidewall so as to hold another of the component parts, said third and fourth jaw sidewalls being oriented in a second orientation with respect to said connection element;

an adjusting means positioned in said connection element, at least one of said second and fourth jaw sidewalls adjustably mounted to said connection element, the at least one of said second and fourth jaw sidewalls having a first lateral leg that projects from one end thereof into an interior of said connection element so as to be separate from and cooperative with said adjusting means, said adjusting means for being activated from an exterior of said connection element in a direction so as to brace or detach the at least one of said second and fourth jaw sidewalls, said second jaw sidewall having a second lateral leg, said adjusting means being in active connection with said first and second lateral legs, said first and second lateral legs releasably grasping onto diagonally opposing sides of said adjusting means.

2. The device of claim 1, said connection element having a housing, said adjusting means for activating said first lateral leg so that the at least one of said second and fourth jaw sidewalls is rotatable about a rotation axis on said housing.

3. The device of claim 1, said adjusting means comprising an eccentric that is rotatably set in bearings.

4. the device of claim 1, said adjusting means comprising an adjustment element that is set in bearings via cylindrical guide surfaces in said connection element.

5. The device of claim 4, said bearings of said cylindrical guide surfaces having a radial play of between approximate 0.4 to 1 millimeter.

6. The device of claim 1, said adjusting means for entering into a self-locking brace with said first lateral leg.

7. The connection device of claim 1, said first and third jaw sidewalls being fixed, said second jaw sidewall lying opposite said first jaw sidewall, and fourth jaw sidewall lying opposite said third jaw sidewall.

8. The connection device of claim 1, said adjusting means comprising:

a first adjustment element; and a second adjustment element arranged coaxially with respect to said first adjustment element.

9. A connection device for detachably connecting component parts comprising:

a connection element;

a first jaw sidewall extending from said connection element;

a second jaw sidewall extending from said connection element and arranged with respect to said first jaw sidewall so as to hold one of the component parts, said first and second jaw sidewalls being oriented in a first orientation with respect to said connection element;

a third jaw sidewall extending from said connection element;

a fourth jaw sidewall extending from said connection element and arranged with respect to said third jaw sidewall so as to hold another of the component parts, said third and fourth jaw sidewalls being oriented in a second orientation with respect to said connection element;

an adjusting means positioned in said connection element, at least one of said second and fourth jaw sidewalls adjustably mounted to said connection element, the at least one of said second and fourth jaw sidewalls having a first lateral leg that projects from one end thereof into an interior of said connection element so as to be separate from and cooperative with said adjusting means, said adjusting means for being activated from an exterior of said connection element in a direction so as to brace or detach the at least one of said second and fourth jaw sidewalls, said adjusting means comprising:

a first adjustment element; and a second adjustment element arranged coaxially with respect to said first adjustment element, said second adjustment element having an opening therein, said first adjustment element being activatable through said opening.

10. A connection device for detachably connecting component parts comprising:

a connection element;

a first jaw sidewall extending from said connection element;

a second jaw sidewall extending from said connection element and arranged with respect to said first jaw sidewall so as to hold one of the component parts, said first and second jaw sidewalls being oriented in a first orientation with respect to said connection element;

a third jaw sidewall extending from said connection element;

a fourth jaw sidewall extending from said connection element and arranged with respect to said third jaw sidewall so as to hold another of the component parts, said third and fourth jaw sidewalls being oriented in a second orientation with respect to said connection element;

an adjusting means positioned in said connection element, at least one of said second and fourth jaw sidewalls adjustably mounted to said connection element, the at least one of said second and fourth jaw sidewalls having a first lateral leg that projects from one end thereof into an interior of said connection element so as to be separate from and cooperative with said adjusting means, said adjusting means for being activated from an exterior of said connection element in a direction so as to brace or detach the at least one of said second and fourth jaw sidewalls, said adjusting means comprising:

a first adjustment element; and a second adjustment element arranged coaxially with respect to said first adjustment element, each of said first and second adjustment elements being activatable by an activatable by an Allen wrench.

11. A connection device for detachably connecting component parts comprising:

a connection element;

a first jaw sidewall extending from said connection element;

a second jaw sidewall extending from said connection element and arranged with respect to said first jaw sidewall so as to hold one of the component parts, said first and second jaw sidewalls being oriented in a first orientation with respect to said connection element;

a third jaw sidewall extending from said connection element;

a fourth jaw sidewall extending from said connection element and arranged with respect to said third jaw sidewall so as to hold another of the component parts, said third and fourth jaw sidewalls being oriented in a second orientation with respect to said connection element;

an adjusting means positioned in said connection element, at least one of said second and fourth jaw sidewalls adjustably mounted to said connection element, the at least one of said second and fourth jaw sidewalls having a first lateral leg that projects from one end thereof into an interior of said connection element so as to be separate from and cooperative with said adjusting means, said adjusting means for being activated from an exterior of said connection element in a direction so as to brace or detach the at least one of said second and fourth jaw sidewalls, said adjusting mean comprising:

a first adjustment element; and a second adjustment element arranged coaxially with respect to said first adjustment element; and a cover extending over said connection element, said cover having an opening therein, said opening suitable for allowing a wrench to access at least one of said first and second adjustment elements.

12. The device of claim 8, said lateral leg having an offset opposite said adjusting means.

13. The connection device of claim 1, further comprising:

a spacer adapted to be attached to at least one of the jaw sidewalls.

14. The device of claim 13, and spacer being clamped into a recess formed on said at least one of said jaw sidewalls.

15. The device of claim 13, said spacer having a hinge with a rotating bracket on a portion of an edge thereof.

* * * * *